United States Patent [19]

Raigneau

[11] Patent Number: 4,969,220

[45] Date of Patent: Nov. 13, 1990

[54] SPLASH-SUPPRESSING APPARATUS FOR WASHING HANDS

[75] Inventor: Jean-Claude Raigneau, Aillant-sur-Tholon, France

[73] Assignee: Societe Agencinox, Paris, France

[21] Appl. No.: 231,878

[22] Filed: Aug. 12, 1988

[30] Foreign Application Priority Data

Aug. 13, 1987 [FR] France ..... 87 11555

[51] Int. Cl.[5] ..... A47K 1/04

[52] U.S. Cl. ..... 4/619.000; 4/300.3; 4/658

[58] Field of Search ..... 4/619, 300.3, 658, 638, 4/654; 312/228, 115; 220/DIG. 28

[56] References Cited

U.S. PATENT DOCUMENTS

| | | | |
|---|---|---|---|
| 1,225,256 | 5/1917 | Lambrix | 4/658 |
| 1,709,545 | 4/1929 | Sheppard | 4/658 |
| 1,783,712 | 12/1930 | Hernandez | 312/228 |
| 2,504,271 | 4/1950 | Maquire | 4/638 |
| 2,508,808 | 5/1950 | Warman | 4/658 |
| 2,878,091 | 3/1959 | Hammond | 4/638 |
| 2,970,321 | 2/1961 | Rovell et al. | 4/658 |
| 3,975,781 | 8/1976 | Klimboff et al. | 4/647 |

FOREIGN PATENT DOCUMENTS

| | | | |
|---|---|---|---|
| 117807 | 2/1901 | Fed. Rep. of Germany | 312/228 |
| 325735 | 9/1920 | Fed. Rep. of Germany | 4/658 |
| 814264 | 7/1937 | France . | |
| 2176403 | 10/1973 | France . | |
| 1422350 | 1/1976 | United Kingdom . | |

*Primary Examiner*—Charles E. Phillips
*Assistant Examiner*—Edward C. Donovan
*Attorney, Agent, or Firm*—Sandler, Greenblum & Bernstein

[57] ABSTRACT

A splash minimizing apparatus for washing hands having associated valves and fixtures, includes a back plate having an upper portion through which the valves and/or fixtures may be supported, this back panel also having a lower portion; a bottom receptacle affixed to the lower portion of the back panel, the bottom receptacle having portions defining a drain hole; two trapezoid-shaped side panels perpendicularly disposed with respect to the back panel, the side panels having bottom edged portions disposed within the bottom receptacle; a rectangular front panel having an upper edge and a lower edge, the front panel inclinedly disposed with respect to the back plate so that every point on the respective upper lower edges is uniformly distant from the back plate, the upper edge of the front panel spaced further from the back plate than the lower edge, the lower edge of the front panel being disposed within the bottom receptacle; and various bolts and elements which may be sleeves for vertically maintaining the positions of the front panel with respect to the back plate and the positions of the side panels with respect to the back plate.

33 Claims, 4 Drawing Sheets

SPLASH-SUPPRESSING APPARATUS FOR WASHING HANDS

BACKGROUND OF THE INVENTION

1. Field of the Invention

The present invention relates to apparatus for washing hands and, more particularly, to a splash-suppressing apparatus for washing hands that is especially suitable for surgical applications.

2. Background of the Invention

It is very important for physicians to have means for washing their hands in operating rooms and in their medical offices. Proper medical practice requires sterility; clean hands contribute to sterile conditions. Likewise, in the continual struggle to maintain sterility, it is frequently necessary to wash and/or rinse surgical and other medical equipment. In fact, many pieces of medical equipment have been designed with a view towards facilitating their cleaning, e.g., useless recesses and/or recesses difficult to access (except by bacteria) are wholly absent.

Hand and equipment washers purportedly especially suitable for medical environments have heretofore been developed. These prior art apparatus generally combine a sink including a container and various valves and fittings controlled by an operator's foot. Foot control eliminates direct operator contact with the hand-washer, which type of contact would carry a risk of contamination.

It is worth noting that the container portions of hand-washers are virtually never used to actually contain a liquid. In reality, the primary function of the container portion of the medical hand-washer is to protect an operator of the hand-washer from splashing liquids, e.g., water and/or detergent. In addition, because the container is never really used to contain liquid, container sealing means such as a plug are not required.

Notwithstanding the fact that there are prior art hand-washers purportedly especially suitable for medical applications and environments, there are a multitude of ways in which the prior art apparatus may be improved to make them even more suitable for medical applications.

SUMMARY OF THE INVENTION

The present invention provides an improved hand washing apparatus that is especially suitable for medical applications.

According to the teachings of the present invention, an apparatus for washing hands, which apparatus is designed to protect a hand-washer from splashing liquids and which apparatus is adaptable to be mounted on a chassis mounted on a wall, includes a back panel, a bottom receptacle, a front panel, at least four first bolts, at least four second bolts, at least two elements, which may be sleeves, and two lateral side plates. The chassis is adapted to support means for controlling water flow, such as valves and fittings. The chassis has at least two vertical side uprights with portions defining at least two holes each through which bolts may pass and which vertical side uprights have midpoints. The back panel is generally rectangular and has a width and a height and a lower portion. The back panel is mounted on the chassis so as to be vertically disposed. The back panel is also adapted to support means for controlling water flow. The bottom receptacle is perpendicularly disposed over the entire lower portion of the back panel.

The bottom receptacle has upper front and upper side edges. The bottom receptacle is connected to the back panel. Portions of the bottom receptacle define a drain hole. The front plate is generally planar and rectangular. It has a length substantially equal to the width of the back panel and a width substantially equal to half the height of the back panel. The front plate further has a first upper edge portion disposed generally parallel to the back panel and a lower edge portion noncontactedly disposed within the bottom receptacle. The front plate is disposed so as to be inclined with respect to the back panel so that a wash zone of increasing area upwards from the bottom receptacle to the upper edge portion of the front plate is defined. The front plate has portions defining at least four holes through which bolts may pass, which holes are generally aligned with the holes in the vertical side uprights of the chassis. The front panel further has two side portions. At least four first bolts are positioned so as to extend through the holes in the vertical side uprights of the chassis. These bolts have threaded ends disposed towards the front plate. At least four second bolts are positioned so as to extend through the holes in the front plate. These bolts have threaded ends disposed towards the back panel. These at least four second bolts are counter-tightenable with respect to the at least four first bolts. The at least four elements have threaded bolt receiving ends. Each element is threadedly positioned between one of the at least four first bolts and one of the at least four second bolts. At least two of the at least four elements are relatively short and at least two of the at least four elements are relatively long. The at least two relatively short elements are disposed just above the upper side edges of the bottom receptacle. The at least two relatively long elements engage the at least two vertical side uprights of the chassis at approximately the midpoint of those uprights. The two lateral side plates are positioned vertically in planes perpendicular to the back panel and partially and noncontactedly adjacent to the two side portions of the front plate. The side plates have upper horizontal edge portions resting on the at least two relatively long elements and lower portions resting against the at least two relatively short elements, which lower portions are further disposed within said portion receptacle.

The bottom receptacle may include a bottom portion, a front portion having side edge portions perpendicular to the bottom portion and parallel to the back panel, and two side portions perpendicular to both the bottom portion and the front portion, which side portions have edge portions adjacent to the side edge portions of the front portion. In such a case, the back panel may be a facade face having a lower edge and side portions perpendicular to the facade face, which side positions are positioned adjacent to the respective vertical side uprights of the chassis. Still further, in such a case, the bottom receptacle and the back panel may be formed from a single sheet of foldable and weldable material, the bottom portion of the bottom receptacle formed by folding the material on a line that then defines the lower edge of the front facade of the back panel, the side portions of the bottom receptacle being extensions of the side portions of the back panel but for those portions being folded vertically and upward along the edges of the bottom portion of the bottom receptacle so as to be perpendicular to that bottom portion. The front portion of the bottom receptacle would be an extension of the bottom portion of the bottom receptacle but for being folded vertically and upward so as to be perpendicular to both the bottom portion and side portions of the bottom receptacle, in which position its side edge portions are welded to the edge portions of the side portions to which they are adjacent.

Portions of the upper horizontal edge portion of each of said side plates may form at least two semi-cylindrical hooks that engage one of the relatively long elements so as to vertically maintain the position of the side plate.

The upper horizontal edge portions of each said side plates may be curved to form a semi-cylindrical profiled structure having a bottom opening, which structure caps one of said relatively long elements so as to vertically maintain the positioning of the side plate.

According to the teachings of the present invention, the front plate may further have a second upper edge portion disposed generally parallel to the back panel, the first of its two upper edge portions being closer to the back panel than is the second of those two upper edge portions. The first of those two upper edge portions could define a band extending across the entire length of the front plate, which band could have a height just sufficient for support of the relatively long elements and associated second bolts. The second of those two upper edge portions could define a non-projecting edge that covers the second bolts associated with the relatively long elements.

Also according to the teachings of the present invention, the lower edge portion of the front plate could include a longitudinal fold defining a vertical band having a height sufficient to support the relatively short elements and any of the second bolts associated with relatively short cross bars.

A splash minimizing apparatus for washing hands having means for introducing a liquid according to the present invention includes a back plate having an upper portion through which a portion of the means for introducing a liquid may be supported, the back panel also having a lower portion; a bottom receptacle affixed to the lower portion of the back panel, the bottom receptacle having portions defining a drain hole; two trapezoid-shaped side panels perpendicularly disposed with respect to the back panel, the side panels having bottom edge portions disposed within the bottom receptacle; a rectangular front panel having an upper edge and a lower edge, the front panel inclinedly disposed with respect to the back plate so that every point on the respective upper and lower edge is uniformly distance from the back plate, the upper edge of the front panel spaced further from the back plate than the lower edge, the lower edge of the front panel being disposed within the bottom receptacle; means for vertically maintaining the position of the front panel with relation to the back plate; and means for vertically maintaining the position of the side panels with respect to the back plate.

The means for vertically maintaining the position of the front panel and the means for maintaining the position of the side panels may have at least one common element. It may, of course, include a plurality of common elements. Such common elements may include at least two elements and at least four bolts, each of the at least two elements being held in position by two bolts, one of which fixedly engages the back plate and the other of which fixedly engages the front plate. In such a case, the at least two elements would be adaptable to engage portions of said side plates.

According to the teachings of the present invention, the back plate and the bottom receptacle may be integrally connected.

The front plate may have portions covering bolts which are fixedly engaged to it.

It is within the scope of the present invention for the bottom edge portions of the side panels to be noncontactedly disposed within the bottom receptacle. In addition, the lower edge of the front panel may also be noncontactedly disposed within the bottom panel.

Accordingly, it is an object of the present invention to provide a handwashing apparatus that protects operators from splashing.

It is another object of the present invention to provide a hand-washer that is easy to maintain.

It is yet another object of the present invention to provide a hand-washer in which all non-immediately accessible portions of the hand-washer are eliminated.

It is still yet another object of the present invention to provide a hand-washer formed of simple metallic plates that are not in contact with one another so that tiny crevices in which bacteria may proliferate are eliminated.

A further object of the present invention is to provide a hand-washer that is easy to clean because certain lateral plates may be removed so as to give easy access to all portions of the hand-washer.

A still further object of the present invention is to provide a hand-washer that requires no costly welding or polishing operation or even the use of heavy tooling to construct.

Yet a further object of the present invention is to provide a hand-washer that is inexpensive to manufacture.

Still yet another object of the present invention is to provide a hand-washer that may be easily disassembled and transported flat.

BRIEF DESCRIPTION OF THE DRAWINGS

Other objects, advantages, and novel features of the present invention will become apparent from the following detailed description of the invention when considered in conjunction with the accompanying drawings wherein.

DETAILED DESCRIPTION OF THE INVENTION

Figure 1:
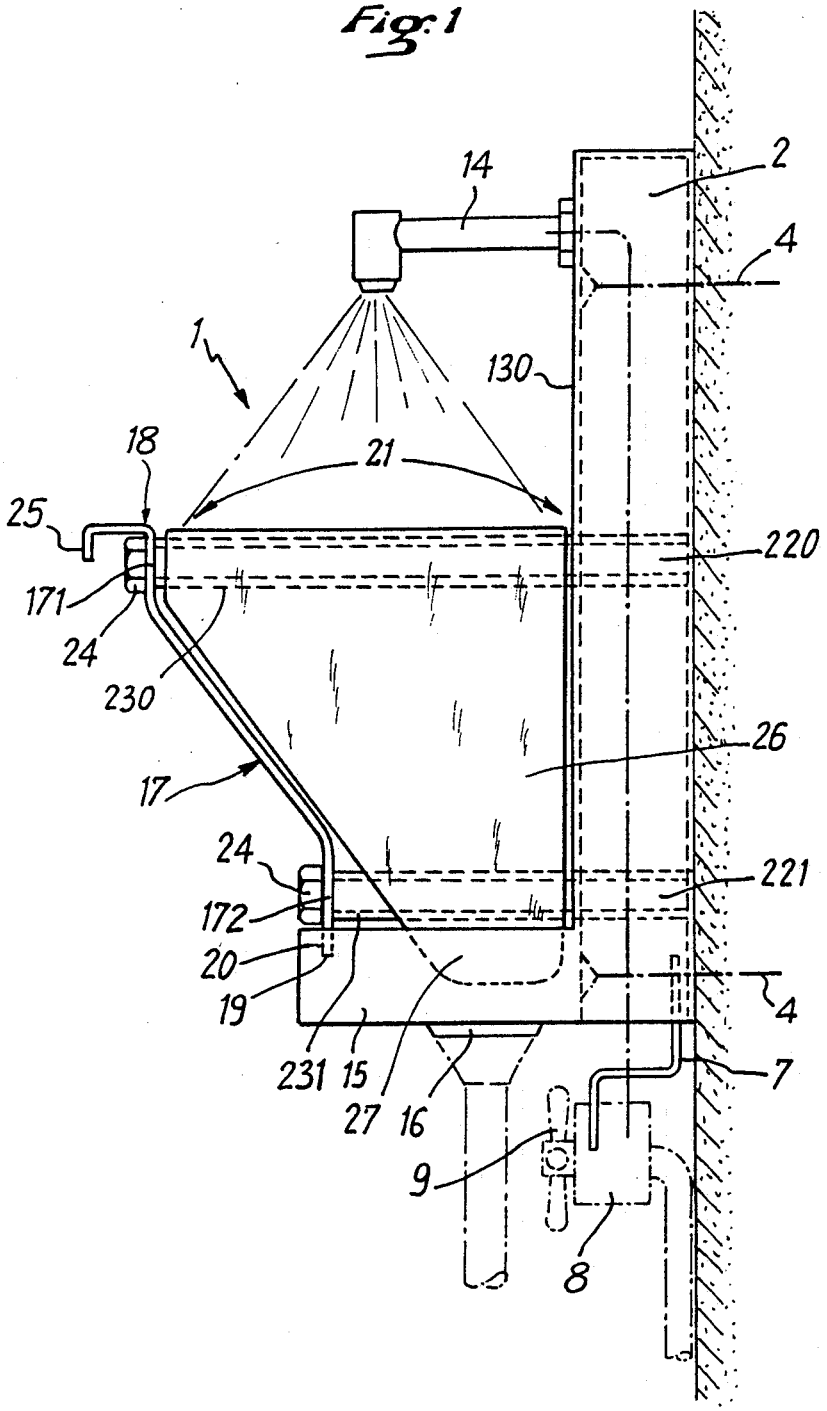
FIG. 1 illustrates a right view of a hand-washing assembly according to the present invention.
Figure 2:
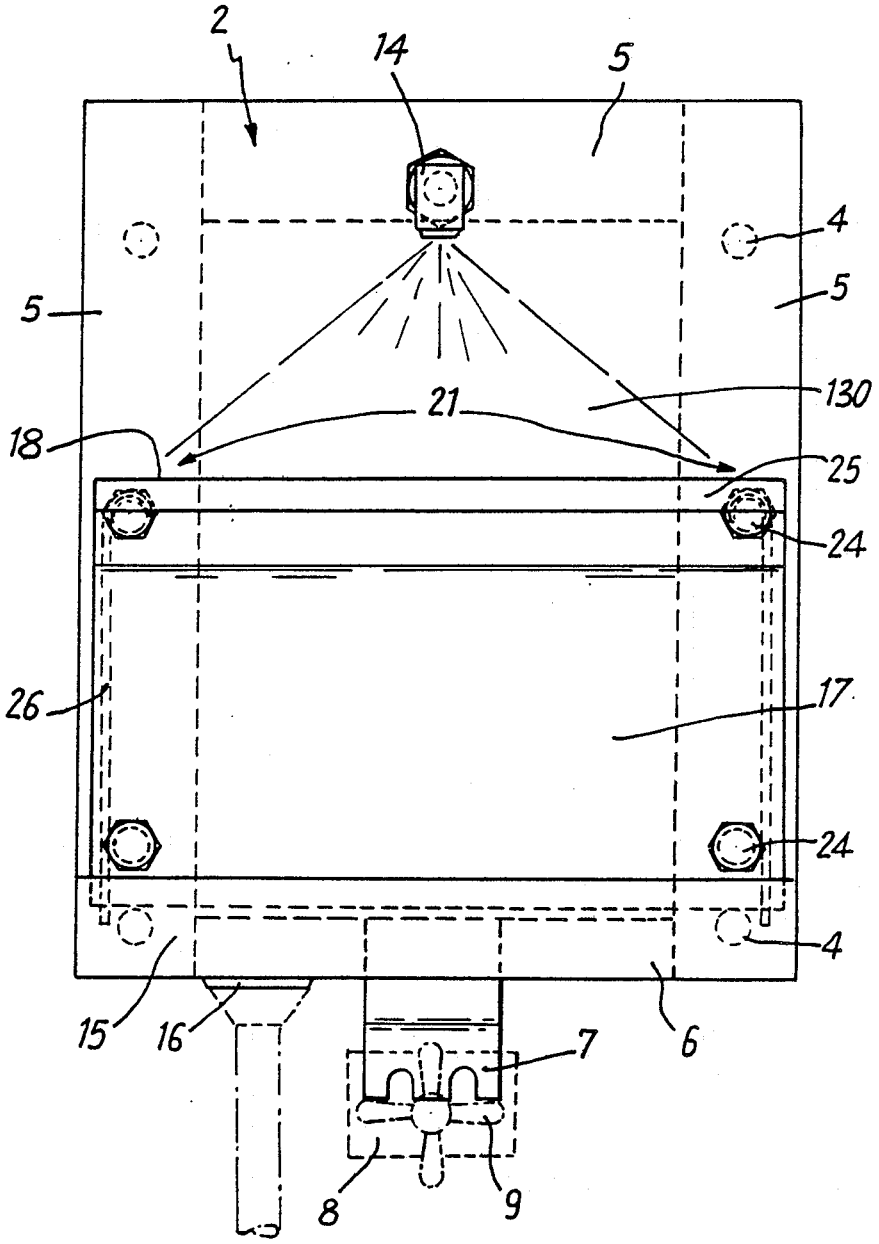
FIG. 2 illustrates a front view of the hand-washing assembly shown in FIG. 1.
Figure 3:
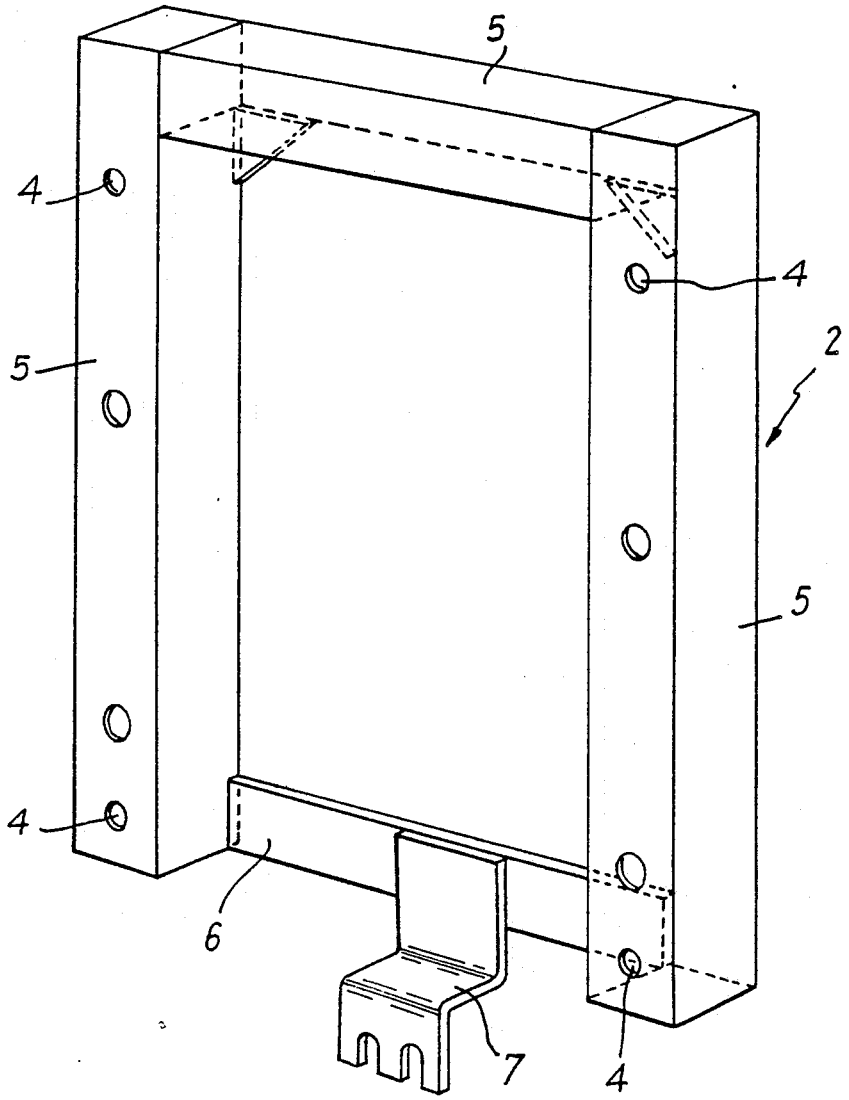
FIG. 3 illustrates a perspective view of the wall attachment chassis of the hand-washer according to present invention.

Referring to FIGS. 1, 2, and 3, a hand-washer 1 according to present invention is mountable on a metal chassis 2 which is attached to a wall 3 by four screws 4. Chassis 2 is shown as a "U" frame formed from a tube 5 having a square cross-sectional area. In FIG. 3, it may be seen that the "U" frame is inverted. Across the bottom open part of the "U" frame is a plate 6, which is attached to the two ends of the "U" frame, and which acts to make that frame more rigid. Dimensions of plate 6 depend upon the desired size of hand-washer 1.

Chassis 2 comprises mean 7 for attachment of a water inlet 8 that is preferably provided with a stopping faucet 9.

Figure 4:
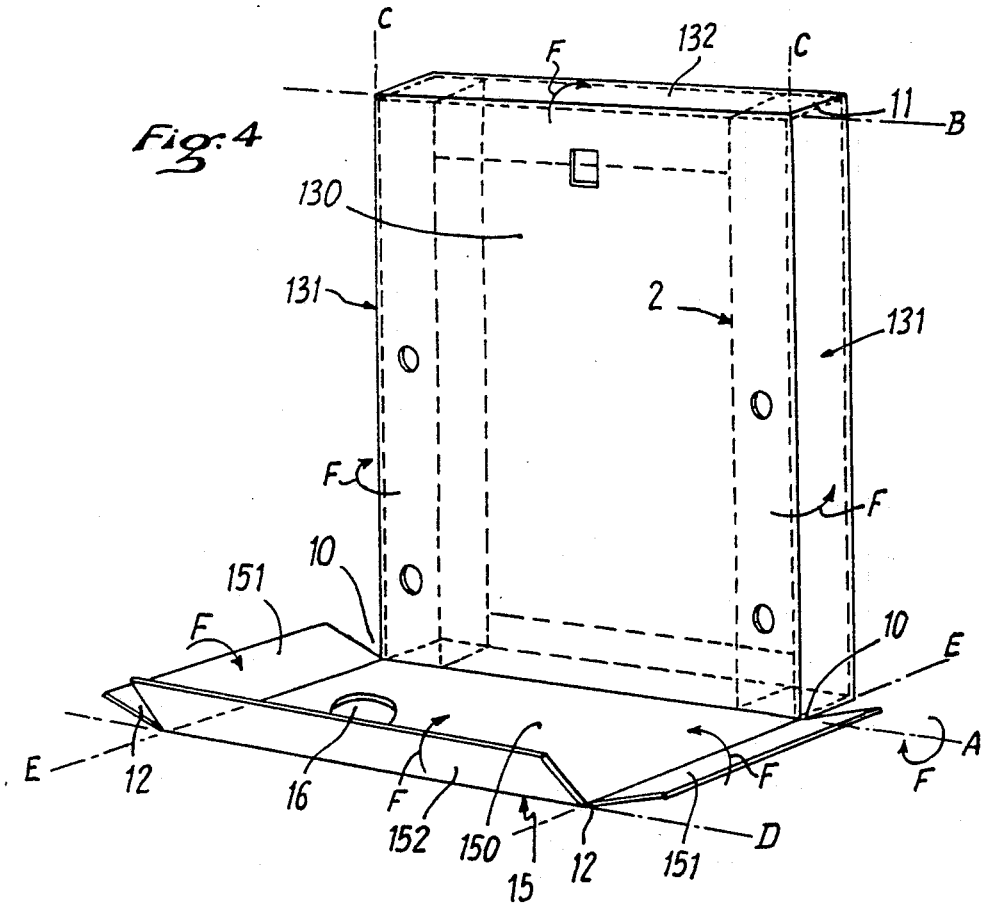
FIG. 4 illustrates a perspective view of a partially assembled, integral back panel and bottom receptacle combination that may be found in certain embodiments of the present invention.

Referring now to FIG. 4, a sheet of stainless steel 13 of sufficient dimension based upon desired size of the hand-washer 1, has cut-out portions 10, 11, and 12, and various folds, preliminarily formed in the direction of arrows F of FIG. 4 along axis A,B,C,D,E. So folded, sheet 13 can be mounted on chassis 2 so as to constitute both a vertical front panel 130 adapted to receive valves and fittings 14 and, after a folding at a right angle of the lower portion of the sheet 13 along axis A in the direction of arrow F in FIG. 4, a bottom receptacle 15 having a drainage hole 16. To this end, cut-outs 10 and 11 of sheet 13 define vertical edges 131 which, by folding at a right angle along axis C, exactly cover the exterior vertical edges of chassis 2. Horizontal edge 132 arises by virtue of rectangular folding along axis B to exactly cover the upper surface of the attachment chassis 2. After simple welding along their lines of contact, edges 131 and 132 are totally enveloped in stainless steel sheet 13.

Likewise, cut-outs 10 and 11 provided in plate 150 folded along axis A define first edges 151 which arise vertically by folds along axis E. A second edge 152 of the same height as the edges of 151 is likewise vertically oriented by folding along axis D. Edges 151 and 152 are welded along their lines of vertical contact at 12 to constitute the bottom receptacle 15. Draining of hand-washer 1 occurs in bottom receptacle 15 by means of drainage hole 16, i.e., hole 16 in bottom plate 150.

At its front, hand-washer 1 is provided with a plate 17 which is preferably planar and rectangular. This plate 17 is positioned in a manner so that an upper edge 18 of the plate is parallel to the plane of vertical panel 130. The length of plate 17 is equal to the width of vertical panel 130 and its width is substantially equal to half the height of panel 130. Plate 17 is preferably inclined with respect to the vertical in a manner so that edge 19 of its lower portion 20 extends within the bottom receptacle and so that upper edge 18 is appropriately spaced from front panel 130 so as to provide a sufficient washing zone 21 at right angles with valves and fittings 14. Inclination of the front panel 17 is maintained by a set of four bolts 24 screwed two each in each of the vertical uprights 5 of the "U" of chassis 2. Two long bolts 220 are implanted substantially at the middle of the two vertical uprights 5 and two short bolts 221 are implanted over a length slightly greater than the width of the receptacle 15 of each of the uprights, just above edges 151 of bottom receptacle 15. The two long bolts 220 have a length sufficient to cross washing zone 21. On bolts 220 and 221 are positioned respective elements 230 and 231 which may be sleeves and are preferably made out of stainless steel. Elements 230 and 231 operate to counter-tighten plate 17 on panel 130 by means of four tightening bolts 24 supported on vertical bands 171 and 172 provided longitudinally at edges 18 and 20 of plate 17. As a result of this configuration, the four bolts 24 rigidly support the hand-washing assembly on its attachment chassis 2.

Plate 17 preferably also has portions which present a non-projecting upper edge. Such an edge may be obtained by a first fold at 18 and a second fold of the sheet metal at 25. This type of configuration partially covers bolts 24. Accordingly, aesthetic appearance of the hand-washer is enhanced without any sacrifice in ease of disassembly.

Figure 5:
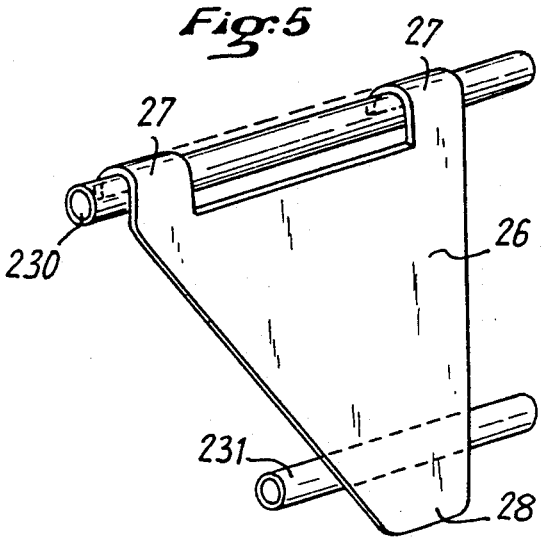
FIG. 5 is a perspective view of the lateral side plate according to an alternative embodiment of the invention showing vertical support on an upper cross-beam and horizontal support by a lower side beam.

So as to protect the environment from splashes which can occur on both sides of hand-washer 1, positioned astride each long elements 230 is a lateral side plate 26. As best seen in FIG. 5, side plates 26 have a substantially trapezoidal rectangular shape. Side plates 26 may be vertically supported on elements 230 by virtue of two hooks 27 or, alternatively, by virture of a semi-cylindrical edge obtained by a manufacturing stamp-out operation. Such a semi-cylindrical edge is shown by the upper dashed lines in FIG. 5.

Thus suspended, side plate 26 rest horizontally against short elements 231, while their ends extend into the interior of receptacle 15. With this configuration, all of the vertical dripping issuing from washing zone 21 falls off edge 19 of front plate 17 into receptacle 15. The shapes of side plates 26 match the interpolated surface between the panel 17 and 130 without, however, there being any contact of the side plate edges 26 on their facing plates 17 and 130.

From the foregoing, it should be clear to those skilled in the art that no accumulation of any matter can occur in the hand-washer of the present invention. This helps ensure that the hand-washer 1 of the present invention will remain clean, as does the fact that hand-washer 1 of the present invention can be very quickly disassembled for complete sterilization.

It should also be appreciated by those skilled in the art that hand-washer 1 of the present invention can be easily constructed because it requires no sealing. Entirely disassembable, and easily couplable to automatic control apparatus such as infrared cells for opening and closing of the valves and fittings 14, the hand-washer of the present invention is especially suitable for clean rooms such as those found in surgical blocks, medical offices, clinical rooms and hospital rooms.

Obviously, many modifications and variations of the present invention are possible in light of the above teachings. For example, it would be within the scope of the present invention to have a bottom receptacle 15 which is entirely applied and welded at the lower portion of panel 130. This type of configuration, and other types of configuration, could be used because of economic considerations that arise during manufacturing processes. Modifications and variations are possible. It is therefore to be understood that within the scope of the appended claims, the invention may be practiced otherwise than as specifically described.

It is claimed:

1. An apparatus for washing hands, said apparatus designed to protect a hand-washer from splashing liquids, said apparatus being mounted on a chassis adaptable to be mounted to a wall, said chassis further adapted to support means for controlling water flow, said chassis having at least two vertical side uprights with portions defining at least two holes through which bolts may pass and which vertical side uprights have midpoints, said apparatus comprising:

a generally rectangular back panel, said back panel having a width and a height and a lower portion, said back panel mounted on said chassis so as to be vertically disposed, said back panel adapted to support means for controlling water flow;

a bottom receptacle perpendicularly disposed over the entire lower portion of said back panel, said bottom receptacle having upper front and upper side edges, said bottom receptacle connected to said back panel, portions of said bottom receptacle defining a drain hole;

a generally rectangular front plate having a length substantially equal to the width of said back panel and a width substantially equal to half the height of said back panel, said front plate further having a first upper edge portion disposed generally parallel to said back panel and a lower edge portion noncontactedly disposed within said bottom receptacle, said front plate disposed so as to be included with respect to said back panel so that a wash zone of increasing area upwards from the bottom receptacle to the upper edge portion of the front plate is defined, said front plate having portions defining at least four holes through which bolts may pass, which holes are generally aligned with the holes in the vertical side uprights of said chassis, said front panel further having two side portions;

at least four first bolts positioned so as to extend through the holes in the vertical side uprights of said chassis, said bolts having threaded ends disposed towards said front plate;

at least four second bolts positioned so as to extend through the holes in said front plate, said bolts having threaded ends disposed towards said back panel, said at least four second bolts being countertightenable with respect to said at least four first bolts;

at least four elements having thread bolt receiving ends, each element threadedly positioned between one of said at least four first bolts and one of said at least four second bolts, at least two of said at least four elements being relatively short and at least two of said at least four elements being relatively long, said at least two relatively short elements being disposed just above the upper side edges of said bottom receptacle, said at least two relatively long elements engaging the at least two vertical side uprights of said chassis at approximately the midpoint of those uprights; and two lateral side plates, said side plates positioned vertically in planes perpendicular to said back panel and partially and noncontactedly adjacent to the two side portions of said front plate, said side plates having upper horizontal edge portions resting on the at least two relatively long elements and lower portions resting against the at least two relatively short elements which lower portions are further disposed within said portion receptacle.

2. An apparatus as recited in claim 1 wherein said bottom receptacle comprises a bottom portion, a front portion having side edge portions perpendicular to said bottom portion and parallel to said back panel, and two side portions perpendicular to both the bottom portion and the front portion which side portions have edge portions adjacent to the side edge portions of the front portion;

wherein said back panel comprises a facade face having a lower edge and side portions perpendicular to the facade face, which side positions are positioned adjacent to the respective vertical side uprights of said chassis; and wherein said bottom receptacle and said back panel are formed from a single sheet of foldable and weldable material, the bottom portion of said bottom receptacle formed by folding the material on a line that then defines the lower edge of the front facade of the back panel, the side portions of the bottom receptacle are extensions of the side portions of said back panel but for those portions being folded vertically and upward along the edges of the bottom portion of the bottom receptacle so as to be perpendicualr to that bottom portion, the front portion of the bottom receptacle would be an extension of the bottom portion of the bottom receptacle but for being folded vertically and upward so as to be perpendicular to both the bottom portion and side portions of said bottom receptacle, in which position its side edge portions are welded to the edge portions of the side portions to which they are adjacent.

3. An apparatus as recited in claim 2 wherein portions of the upper horizontal edge portion of each of said side plates form at least two semi-cylindrical hooks that engage one of said relatively long element so as to vertically maintain the position of the side plate.

4. An apparatus as recited in claim 3 wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

5. An apparatus as recited in claim 4, wherein the lower edge portion of said front plate comprises a longitudinal fold defining a vertical band having a height sufficient to support the relatively short elements and any of the second bolts associated with relatively short elements.

6. An apparatus as recited in claim 3, wherein the lower edge portion of said front plate comprises a longitudinal fold defining a vertical band having a height sufficient to support the relatively short elements and any of the second bolts associated with relatively short elements

7. An apparatus as recited in claim 2 wherein the upper horizontal edge portions of each said side plates are curved to form a semi-cylindrical profiled structure having a bottom opening, which structure caps one of said relatively long elements so as to vertically maintain the position of the side plate.

8. An apparatus as recited in claim 7 wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

9. An apparatus as recited in claim 8, wherein the lower edge portion of said front plate comprises a longitudinal fold defining a vertical band having a height sufficient to support the relatively short elements and any of the second bolts associated with relatively short elements.

10. An apparatus as recited in claim 7, wherein the lower edge portion of said front plate comprises a longitudinal fold defining a vertical band having a height sufficient to support the relatively short elements and any of the second bolts associated with relatively short elements.

11. An apparatus as recited in claim 2 wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

12. An apparatus as recited in claim 11, wherein the lower edge portion of said front plate comprises a longitudinal fold defining a vertical band having a height sufficient to support the relatively short elements and any of the second bolts associated with relatively short elements.

13. An apparatus as recited in claim 2, wherein the lower edge portion of said front plate comprises a longitudinal fold defining a vertical band having a height sufficient to support the relatively short elements and any of the second bolts associated with relatively short elements.

14. An apparatus as recited in claim 1, wherein portions of the upper horizontal edge portion of each of said side plates form at least two semi-cylindrical hooks that engage one of said relatively long element so as to vertically maintain the position of the side plate.

15. An apparatus as recited in claim 14 wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

16. An apparatus as recited in claim 15, wherein the lower edge portion of said front plate comprises a longitudinal fold defining a vertical band having a height sufficient to support the relatively short elements and any of the second bolts associated with relatively short elements.

17. An apparatus as recited in claim 14, wherein the lower edge portion of said front plate comprises a longitudinal fold defining a vertical band having a height sufficient to support the relatively short elements and any of the second bolts associated with relatively short elements.

18. An apparatus as recited in claim 1, wherein the upper horizontal edge portions of each said side plates are curved to form a semi-cylindrical profiled structure having a bottom opening, which structure caps one of said relatively long elements so as to vertically maintain the position of the side plate.

19. An apparatus as recited in claim 18 wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

20. An apparatus as recited in claim 19, wherein the lower edge portion of said front plate comprises a longitudinal fold defining a vertical band having a height sufficient to support the relatively short elements and any of the second bolts associated with relatively short elements.

21. An apparatus as recited in claim 18, wherein the lower edge portion of said front plate comprises a longitudinal fold defining a vertical band having a height sufficient to support the relatively short elements and any of the second bolts associated with relatively short elements.

22. An apparatus as recited in claim 1, wherein said front plate further has a second upper edge portion disposed generally parallel to said back panel, the first of those two upper edge portions being closer to said back panel than is the second of those two upper edge portions, the first of those two upper edge portions defining a band extending across the entire length of the front plate, which band has a height just sufficient for support of the relatively long elements and associated second bolts, the second of those two upper edge portions defining a non-projecting edge that covers the second bolts associated with the relatively long elements.

23. An apparatus as recited in claim 22, wherein the lower edge portion of said front plate comprises a longitudinal fold defining a vertical band having a height sufficient to support the relatively short elements and any of the second bolts associated with relatively short elements.

24. An apparatus as recited in claim 1, wherein the lower edge portion of said front plate comprises a longitudinal fold defining a vertical band having a height sufficient to support the relatively short elements and any of the second bolts associated with relatively short elements.

25. A splash minimizing apparatus for washing hands having means for introducing a liquid, said apparatus comprising:

a back panel having an upper portion through which a portion of the means for introducing a liquid may be supported, said back panel also having a lower portion;

a bottom receptacle affixed to the lower portion of said back panel, said bottom receptacle having portions defining a drain hole;

two side panels perpendicularly disposed with respect to said back panel, said side panels having bottom edge portions disposed within said bottom receptacle;

a rectangular front panel having an upper edge and a lower edge, said front panel inclinedly disposed with respect to said back panel so that every point on the respective upper and lower edge is uniformly distant from said back panel, the upper edge of said front panel being spaced further from said back panel than the lower edge, the lower edge of said front panel being disposed within said bottom receptable;

means for vertically maintaining the position of the front panel with relation to said back panel;

means for vertically maintaining the position of the side panels with respect to said back panel; and said means for vertically maintaining the position of the front panel and said means for maintaining the position of the side panels comprise at least one common element, said at least one common element including at least two elements and at least four bolts, each of said at least two elements being held in position by two bolts, one of which bolts fixedly engages said back panel and the other of which bolts fixedly engages said front panel, said at least two elements being adaptable to engage portions of said side panels.

26. An apparatus as recited in claim 25 wherein said back panel and said bottom receptacle are integrally connected.

27. An apparatus as recited in claim 25 wherein the bottom edge portions of said side panels are disposed within said bottom receptacle and spaced from said bottom receptacle.

28. An apparatus as recited in claim 25 wherein said two side panels are trapezoidal-shaped.

29. A splash minimizing apparatus for washing hands havingg means for introducing a liquid, said apparatus comprising:

a back panel having an upper portion through which a portion of the means for introducing a liquid may be supported, said back panel also having a lower portion;

a bottom receptacle affixed to the lower portion of said back panel, said bottom receptacle having portions defining a drain hole;

two side panels perpendicularly disposed with respect to said back panel, said side panels having bottom edge portions disposed within said bottom receptacle;

a rectangular front panel having an upper edge and a lower edge, said front panel inclinedly disposed with respect to said back panel so that every point on the respective upper and lower edge is uniformly distant from said back panel, the upper edge of said front panel being spaced further from said back panel than the lower edge, the lower edge of said front panel being disposed within said bottom receptacle;

means for vertically maintaining the position of the front panel with relation to said back panel;

means for vertically maintaining the position of the side panels with respect to said back panel; and said means for vertically maintaining the position of the front panel and said means for vertically maintaining the position of the side panels comprise a plurality of common elements, said plurality of common elements including at least one element and at least one bolt, said at least one element being held in position by said bolt which fixedly engages said front panel, said front panel including portions at least partially covering said bolt.

30. An apparatus as recited in claim 29 wherein the lower edge of said front panel is disposed within said bottom receptacle and spaced from said bottom receptacle.

31. An apparatus as recited in claim 29, wherein said back panel and said bottom receptacle are integrally connected.

32. An apparatus as recited in claim 29, wherein the bottom edge portions of said side panels are disposed within said bottom receptacle and spaced from said bottom receptacle.

33. An apparatus as recited in claim 29, wherein said two side panels are trapezoidal-shaped.

* * * * *

UNITED STATES PATENT AND TRADEMARK OFFICE

CERTIFICATE OF CORRECTION

PATENT NO. : 4,969,220

DATED : November 13, 1990

INVENTOR(S) : J. RAIGNEAU

It is certified that error appears in the above-identified patent and that said Letters Patent is hereby corrected as shown below:

On title page, item [73] Assignee: change "Paris" to --Aillant sur Tholon---.

Signed and Sealed this

Thirtieth Day of March, 1993

*Attest:*

STEPHEN G. KUNIN

*Attesting Officer*

*Acting Commissioner of Patents and Trademarks*